US011490200B2

(12) United States Patent
Hou et al.

(10) Patent No.: US 11,490,200 B2
(45) Date of Patent: Nov. 1, 2022

(54) AUDIO SIGNAL PROCESSING METHOD AND DEVICE, AND STORAGE MEDIUM

(71) Applicant: Beijing Xiaomi Pinecone Electronics Co., Ltd., Beijing (CN)

(72) Inventors: Haining Hou, Beijing (CN); Jiongliang Li, Beijing (CN); Xiaoming Li, Beijing (CN)

(73) Assignee: Beijing Xiaomi Pinecone Electronics Co., Ltd., Beijing (CN)

( * ) Notice: Subject to any disclaimer, the term of this patent is extended or adjusted under 35 U.S.C. 154(b) by 0 days.

(21) Appl. No.: 16/987,915

(22) Filed: Aug. 7, 2020

(65) Prior Publication Data

US 2021/0289293 A1 Sep. 16, 2021

(30) Foreign Application Priority Data

Mar. 13, 2020 (CN) ..... 202010176172.X

(51) Int. Cl.
*H04R 3/00* (2006.01)
*G10L 21/0224* (2013.01)
(Continued)

(52) U.S. Cl.
CPC ..... *H04R 3/005* (2013.01); *G10L 21/0224* (2013.01); *G10L 21/0232* (2013.01); *G10L 25/45* (2013.01); *G10L 2021/02161* (2013.01)

(58) Field of Classification Search
None
See application file for complete search history.

(56) References Cited

U.S. PATENT DOCUMENTS

2004/0083095 A1 4/2004 Ashley et al.
2010/0056063 A1 3/2010 Sudo

FOREIGN PATENT DOCUMENTS

JP 2004-520616 A 7/2004
JP 2010-055024 A 3/2010
(Continued)

OTHER PUBLICATIONS

Wood et al., Blind Speech Separation and Enhancement with GCC-NMF, 25 IEEE/ACM Trans. On Audio, Speech and Language Processing 745 (Apr. 2017). (Year: 2017).*
(Continued)

*Primary Examiner* — Walter F Briney, III
(74) *Attorney, Agent, or Firm* — Finnegan, Henderson, Farabow, Garrett & Dunner, L.L.P.

(57) ABSTRACT

An audio signal processing method includes: acquiring audio signals from at least two sound sources respectively through at least two microphones (MICs) to obtain respective original noisy signals of the at least two MICs in a time domain; for each frame in the time domain, using a first asymmetric window to perform a windowing operation on the respective original noisy signals of the at least two MICs to acquire windowed noisy signals; performing time-frequency conversion on the windowed noisy signals to acquire respective frequency-domain noisy signals of the at least two sound sources; acquiring frequency-domain estimated signals of the at least two sound sources according to the frequency-domain noisy signals; and obtaining audio signals produced respectively by the at least two sound sources according to the frequency-domain estimated signals.

18 Claims, 7 Drawing Sheets

(51) Int. Cl.

| | |
|---|---|
| ***G10L 21/0232*** | (2013.01) |
| ***G10L 25/45*** | (2013.01) |
| ***G10L 21/0216*** | (2013.01) |

(56) References Cited

FOREIGN PATENT DOCUMENTS

| | | | |
|---|---|---|---|
| JP | 2012-181233 | A | 9/2012 |
| KR | 20100010356 | A | 2/2010 |
| WO | WO 2007/058121 | A1 | 5/2007 |

OTHER PUBLICATIONS

Sean U N Wood et al: "Unsupervised Low Latency Speech Enhancement with RT-GCC-NMF", IEEE Journal of Selected Topics in Signal Processing, vol. X, No. X, 201X, arxiv.org, Cornell University Library, 201 Olin Library Cornell University Ithaca, NY 14853, Apr. 5, 2019, 15 pages.

European Search Report in European Application No. 20193324.9, dated Jan. 26, 2021.

Notice of Reasons for Refusal dated Sep. 13, 2021, from the Japanese Patent Office in counterpart Japanese Application No. 2020-129305.

Notice of Submission of Opinion of Korean Application No. 10-2020-0095606, dated Jun. 28, 2022.

* cited by examiner

AUDIO SIGNAL PROCESSING METHOD AND DEVICE, AND STORAGE MEDIUM

CROSS-REFERENCE TO RELATED APPLICATION

This application is based upon and claims priority to Chinese Patent Application No. 202010176172.X, filed on Mar. 13, 2020, the entire contents of which are incorporated herein by reference.

TECHNICAL FIELD

The present disclosure generally relates to the technical field of signal processing, and more particularly, to an audio signal processing method and device, and a storage medium.

BACKGROUND

An intelligent device may use a microphone (MIC) array for receiving sound. A MIC beamforming technology may be used to improve voice signal processing quality to increase a voice recognition rate in a real environment. However, a multi-MIC beamforming technology may be sensitive to a MIC position error, thereby affecting performance. In addition, increase of the number of MICs may increase product cost of the device.

Therefore, more and more intelligent devices are provided with only two MICs. A blind source separation technology completely different from the multi-MIC beamforming technology may be used for the two MICs for voice enhancement. How to improve the processing efficiency of blind source separation and reduce the latency is a problem to be solved in the blind source separation technology.

SUMMARY

According to a first aspect of embodiments of the present disclosure, an audio signal processing method may include: acquiring audio signals from at least two sound sources respectively through at least two microphones (MICs) to obtain respective original noisy signals of the at least two MICs in a time domain; for each frame in the time domain, performing a windowing operation on the respective original noisy signals of the at least two MICs using a first asymmetric window to acquire windowed noisy signals; performing time-frequency conversion on the windowed noisy signals to acquire respective frequency-domain noisy signals of the at least two sound sources; acquiring frequency-domain estimated signals of the at least two sound sources according to the frequency-domain noisy signals; and obtaining audio signals produced respectively by the at least two sound sources according to the frequency-domain estimated signals.

According to a second aspect of embodiments of the present disclosure, an audio signal processing device may include: a processor; and a memory configured to store instructions executable by the processor. The processor is configured to acquire audio signals from at least two sound sources respectively through at least two microphones (MICs) to obtain respective original noisy signals of the at least two MICs in a time domain; for each frame in the time domain, perform a windowing operation on the respective original noisy signals of the at least two MICs using a first asymmetric window to acquire windowed noisy signals; perform time-frequency conversion on the windowed noisy signals to acquire respective frequency-domain noisy signals of the at least two sound sources; acquire frequency-domain estimated signals of the at least two sound sources according to the frequency-domain noisy signals; and obtain audio signals produced respectively by the at least two sound sources according to the frequency-domain estimated signals.

According to a third aspect of embodiments of the present disclosure, a non-transitory computer-readable storage medium is provided, which may have stored computer-executable instructions that, when executed by a processor, implement the audio signal processing method of the first aspect.

It is to be understood that the above general description and detailed description below are only exemplary and explanatory and not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

Figure 1:
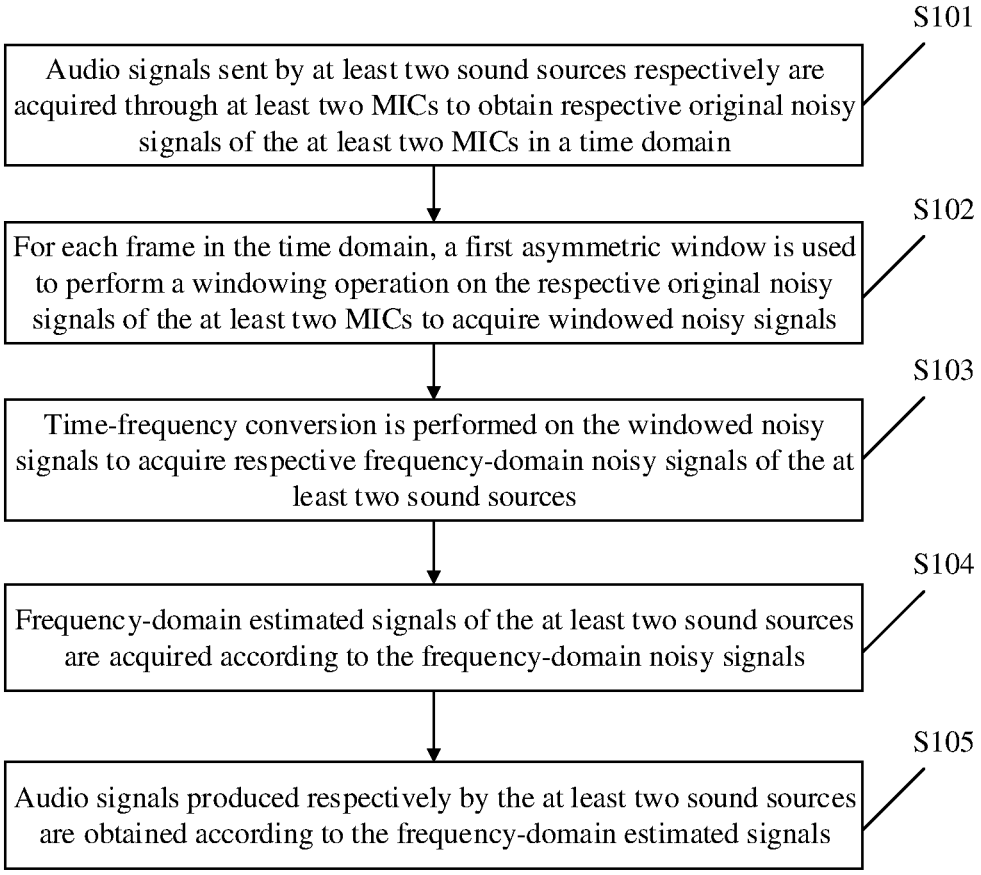
FIG. 1 is a flowchart of an audio signal processing method according to an exemplary embodiment.

FIG. 1 is a flowchart of an audio signal processing method according to an exemplary embodiment. As shown in FIG. 1, the method includes the following operations.

In S101, audio signals sent by at least two sound sources respectively are acquired through at least two MICs to obtain respective original noisy signals of the at least two MICs in a time domain.

In S102, for each frame in the time domain, a first asymmetric window is used to perform a windowing operation on the respective original noisy signals of the at least two MICs to acquire windowed noisy signals.

In S103, time-frequency conversion is performed on the windowed noisy signals to acquire respective frequency-domain noisy signals of the at least two sound sources.

In S104, frequency-domain estimated signals of the at least two sound sources are acquired according to the frequency-domain noisy signals.

In S105, audio signals produced respectively by the at least two sound sources are obtained according to the frequency-domain estimated signals.

The method may be applied to a terminal. The terminal may be an electronic device integrated with two or more than two MICs. For example, the terminal may be a vehicle terminal, a computer, a server, etc.

In an embodiment, the terminal may be an electronic device connected with a predetermined device integrated with two or more than two MICs. The electronic device may receive an audio signal acquired by the predetermined device based on this connection and send the processed audio signal to the predetermined device based on the connection. For example, the predetermined device may be a speaker.

In an embodiment, the terminal may include at least two MICs. The at least two MICs may simultaneously detect the audio signals respectively sent by the at least two sound sources to obtain the respective original noisy signals of the at least two MICs. In the embodiment, the at least two MICs synchronously may detect the audio signals sent by the two sound sources.

In the embodiments, audio signals of audio frames in a predetermined time can be separated after original noisy signals of the audio frames in the predetermined time are acquired.

In the embodiments, there may be two or more than two MICs, and there may be two or more than two sound sources.

In the embodiments, the original noisy signal may be a mixed signal including sounds produced by at least two sound sources. For example, there may be two MICs, e.g., a MIC 1 and a MIC 2 respectively, and there may be two sound sources, e.g., a sound source 1 and a sound source 2 respectively. In such case, the original noisy signal of the MIC 1 may include audio signals of the sound source 1 and the sound source 2, and the original noisy signal of the MIC 2 also may include the audio signals of both the sound source 1 and the sound source 2.

Also for example, there may be three MICs, e.g., a MIC 1, a MIC 2 and a MIC 3 respectively, and there may be three sound sources, e.g., a sound source 1, a sound source 2 and a sound source 3 respectively. In such case, the original noisy signal of the MIC 1 may include the audio signals of the sound source 1, the sound source 2 and the sound source 3, and the original noisy signals of the MIC 2 and the MIC 3 also may include the audio signals of all the sound source 1, the sound source 2 and the sound source 3.

If a signal generated in a MIC based on a sound produced by a sound source is an audio signal, a signal generated by another sound source in the MIC is a noise signal. According to the embodiments of the present disclosure, the sounds produced by the at least two sound sources need to be recovered from the at least two MICs. The number of sound sources may be the same as the number of MICs. In some embodiments, the number of sound sources and the number of MICs also may be different.

When a MIC acquires an audio signal of a sound produced by a sound source, an audio signal of at least one audio frame may be acquired and the acquired audio signal is an original noisy signal of each MIC. The original noisy signal may be a time-domain signal or a frequency-domain signal. When the original noisy signal is a time-domain signal, the time-domain signal may be converted into a frequency-domain signal based on time-frequency conversion.

The time-frequency conversion refers to mutual conversion between a time-domain signal and a frequency-domain signal. Frequency-domain transformation may be performed on a time-domain signal based on Fast Fourier Transform (FFT), Short-Time Fourier Transform (STFT), or other Fourier transform.

For example, when a nth frame of time-domain signal of a pth MIC is $x_p''(m)$, the nth frame of time-domain signal may be converted into a frequency-domain signal, and a nth frame of original noisy signal may be determined to be $X_p(k,n)=STFT(x_p''(m))$, where m is the number of discrete time points of the nth frame of time-domain signal, and k is a frequency point. Therefore, according to the embodiments, each frame of original noisy signal may be obtained by change from the time domain to the frequency domain. Each frame of original noisy signal may also be obtained based on the FFT, which is not limited in the disclosure.

In the embodiments of the present disclosure, an asymmetric analysis window may be used to perform a windowing operation on an original noisy signal in the time domain, and a signal segment of each frame may be intercepted through a first asymmetric window to obtain a windowed noisy signal of each frame. Since voice data and video data are different, there is no concept of frames. However, in order to transmit and store data and to process programs in batches, data may be segmented according to a specified time period or based on the number of discrete time points, thereby forming audio frames in the time domain. However, direct segmentation to form audio frames may destroy the continuity of audio signals. In order to ensure the continuity of audio signals, part of overlapping data need to be retained in different frames. That is, there is a frame shift. The part where two adjacent frames overlap is the frame shift.

The asymmetric window means that a graph formed by a function waveform of a window function is an asymmetric graph. For example, function waveforms on both sides with the peak as the axis may be asymmetric.

In the embodiments of the present disclosure, the window function may be used to process each frame of audio signal, so that the signal can change from the minimum to the maximum and then to the minimum. In this way, the overlapping parts of two adjacent frames may not cause distortion after being superimposed.

When an audio signal is processed based on a symmetric window function, a frame shift may be half of a frame length, which may cause a large system latency, thereby reducing the separation efficiency and degrading the real-time interactive experience. Therefore, in the embodiments of the present disclosure, the asymmetric window is adopted to perform windowing processing on an audio signal, so that after each frame of audio signal is subjected to windowing, a higher intensity signal can be in the first half or the second half. Therefore, the overlapping parts between two adjacent frames of signals can be concentrated in a shorter interval, thereby reducing the latency and improving the separation efficiency.

In some embodiments, a definition domain of the first asymmetric window $h_A(m)$ may be greater than or equal to 0 and less than or equal to N, a peak may be $h_A(m_1)=1$, $m_1$ may be less than N and greater than 0.5N, and N may be a frame length of the audio signal.

In the embodiments of the present disclosure, the first asymmetric window $h_A(m)$ may be used as an analysis window to perform windowing processing on the original noisy signal of each frame. The frame length of the system is N, and the window length is also N, that is, each frame of signal has audio signal samples at N discrete time points.

The windowing processing performed according to the first asymmetric window may be multiplying a sample value at each time point of a frame of audio signal by a function value at a corresponding time point of the function $h_A(m)$, so that each frame of audio signal subjected to windowing can gradually get larger from 0 and then gradually get smaller. At the time point $m_1$ of the peak of the first asymmetric window, the windowed audio signal is the same as the original audio signal.

In the embodiments of the present disclosure, the time point $m_1$ where the peak of the first asymmetric window is may be less than N and greater than 0.5N, that is, after the center point. In such case, an overlap between two adjacent frames can be reduced, that is, the frame shift is reduced, thereby reducing the system latency and improving the efficiency of signal processing.

In some embodiments, the first asymmetric window $h_A(m)$ may include formula (1):

$$h_A(m) = \begin{cases} \sqrt{H_{2(N-M)}(m)} & 1 \le m \le N-M \\ \sqrt{H_{2M}(m-(N-2M))} & N-M \le m \le N \\ 0 & \text{other} \end{cases} \quad (1)$$

where $H_K(x)$ is a Hanning window with a window length of K, and M is a frame shift.

In the embodiments of the present disclosure, the first asymmetric window in formula (1) is provided. When the value of the time point m is less than N–M, the function of the first asymmetric window is represented by $h_A(m)=\sqrt{H_{2(N-M)}(m)}$, where $H_{2(N-M)}(m)$ is a Hanning window with a window length of 2(N–M). The Hanning window is a type of cosine window, which may be represented by formula (2):

$$H_N(m) = \frac{1}{2}\left(1-\cos\left(2\pi\frac{m-1}{N}\right)\right), \quad 1 \le m \le N \quad (2)$$

When the value of the time point m is greater than N–M, the function of the first asymmetric window is represented by $h_A(m)=\sqrt{H_{2M}(m-(N-2M))}$, where $H_{2M}(m-(N-2M))$ is a Hanning window with a window length of 2M.

Therefore, the peak value of the first asymmetric window is at m=N–M. In order to reduce the latency, the frame shift M may be set smaller, for example, M=N/4 or M=N/8, etc. In this way, the total latency of the system is only 2M, but less than N, so that the latency can be reduced.

In some embodiments, the operation that audio signals produced respectively by the at least two sound sources are obtained according to the frequency-domain estimated signals may include that: time-frequency conversion is performed on the frequency-domain estimated signals to acquire respective time-domain separation signals of the at least two sound sources; a windowing operation is performed on the respective time-domain separation signals of the at least two sound sources using a second asymmetric window to acquire windowed separation signals; and audio signals produced respectively by the at least two sound sources are acquired according to windowed separation signals.

In the embodiments of the present disclosure, an original noisy signal may be converted into a frequency-domain noisy signal after windowing processing and video conversion. Based on the frequency-domain noisy signal, separation processing may be performed to obtain frequency-domain signals of at least two sound sources after separation. In order to restore the audio signals of at least two sound sources, the obtained frequency-domain signal may be converted back to the time domain after time-frequency conversion.

Time-domain conversion may be performed on the frequency-domain signal to obtain the frequency-domain signal based on Inverse Fast Fourier Transform (IFFT), Inverse Short-Time Fourier Transform (ISTFT), or other Fourier transform.

The separation signal back to the time domain is a time-domain separation signal in which each sound source is divided into different frames. In order to obtain a continuous audio signal from the sound source, windowing may be performed again to remove unnecessary duplicate parts. Then, continuous audio signals may be obtained by synthesis, and the respective audio signals from the sound sources are restored.

In this way, the noise in the restored audio signal can be reduced and the signal quality can be improved.

In some embodiments, the operation that a windowing operation is performed on the respective time-domain separation signals of the at least two sound sources using a second asymmetric window to acquire windowed separation signals may include that: a windowing operation is performed on the time-domain separation signal of the nth frame using a second asymmetric window $h_S(m)$ to acquire an nth-frame windowed separation signal. The operation that audio signals produced respectively by the at least two sound sources are acquired according to windowed separation signals may include that: the audio signal of the (n–1)th frame is superimposed according to the nth-frame windowed separation signal to obtain the audio signal of the nth frame, where n is an integer greater than 1.

In the embodiments of the present disclosure, a second asymmetric window may be used as a synthesis window to perform windowing processing on the above time-domain separation signal to obtain windowed separation signals. Then, the windowed separation signal of each frame may be added to a time-domain overlapping part of a preceding frame to obtain a time-domain separation signal of a current frame. In this way, a restored audio signal can maintain continuity and can be closer to the audio signal from the original sound source, and the quality of the restored audio signal can be improved.

In some embodiments, a definition domain of the second asymmetric window $h_S(m)$ may be greater than or equal to 0 and less than or equal to N, a peak may be $h_S(m_2)=1$, $m_2$ may be equal to N–M, N may be a frame length of each of the audio signals, and M may be a frame shift.

In the embodiments of the present disclosure, the second asymmetric window may be used as a synthesis window to perform windowing processing on each frame of separation audio signal. The second asymmetric window may take values within twice the length of the frame shift, intercept the last 2M audio segments of each frame, and then add them to the overlapping part between a preceding frame and the current frame, that is, the frame shift part, to obtain the time-domain separation signal of the current frame. In this way, an audio signal from an original sound source can be restored based on consecutive processed frames.

In some embodiments, the second asymmetric window $h_S(m)$ may include:

$$h_S(m) = \begin{cases} \dfrac{H_{2M}(m-(N-2M))}{\sqrt{H_{2(N-M)}(m)}} & N-2M+1 \le m \le N-M \\ \sqrt{H_{2M}(m-(N-2M))} & N-M+1 \le m \le N \\ 0 & \text{other} \end{cases} \quad (3)$$

where $H_K(x)$ is a Hanning window with a window length of K.

In the embodiments of the present disclosure, the second asymmetric window shown in formula (3) is provided. When the value of the time point m is less than N–M and greater than N–2M+1, the function of the first asymmetric window is represented by $$h_S(m) = \frac{\sqrt{H_{2M}(m-(N-2M))}}{\sqrt{H_{2(N-M)}(m)}},$$

where $H_{2(N-M)}(m)$ is a Hanning window with a window length of 2(N–M), and $H_{2M}(m-(N-2M))$ is a Hanning window with a window length of 2M.

When the value of the time point m is greater than N–M, the function of the second asymmetric window is represented by $h_S(m)=\sqrt{H_{2M}(m-(N-2M))}$, where $H_{2M}(m-(N-2M))$ is a Hanning window with a window length of 2M. In this way, the peak value of the second asymmetric window is also located at m=N–M.

In some embodiments, the operation that frequency-domain estimated signals of the at least two sound sources are acquired according to the frequency-domain noisy signals may include that: a frequency-domain priori estimated signal is acquired according to the frequency-domain noisy signals; a separation matrix of each frequency point is determined according to the frequency-domain priori estimated signal; and the frequency-domain estimated signals of the at least two sound sources are acquired according to the separation matrix and the frequency-domain noisy signals.

According to an initialized separation matrix or a separation matrix of a preceding frame, a frequency-domain noisy signal may be preliminarily separated to obtain a priori estimated signal, and then the separation matrix may be updated according to the priori estimated signal. Finally, the frequency-domain noisy signal can be separated according to the separation matrix to obtain a separated frequency-domain estimated signal, that is, a frequency-domain posterior estimated signal.

For example, the above separation matrix may be determined based on an eigenvalue solved by a covariance matrix. The covariance matrix $V_p(k,n)$ may satisfy the following relationship $V_p(k,n)=\beta V_p(k,n-1)+(1-\beta)\varphi_p(k,n) X_p(k,n) X_p^H(k,n)$, where $\beta$ is a smoothing coefficient, $V_p(k,n-1)$ is the covariance matrix of the preceding frame, and $X_p(k,n)$ is the original noisy signal of the current frame, that is, the frequency-domain noisy signal. $X_p^H(k,n)$ is a conjugate transpose matrix of the original noisy signal of the current frame.

$$\varphi_p(k, n) = \frac{G'(Y_p(n))}{r_p(n)}$$

is a weighting factor, where $$r_p(n) = \sqrt{\sum_{k=1}^{K} |Y_p(k, n)|^2}$$

is an auxiliary variable. $G(\overline{Y}_p(n))=-\log p(\overline{Y}_p(n))$ is a contrast function. Herein, $p(\overline{Y}_p(n))$ represents a multi-dimensional super-Gaussian prior probability density distribution model based on the entire frequency band of the pth sound source, which is the above-mentioned distribution function. $\overline{Y}_p(n)$ is a conjugate matrix of $Y_p(n)$, $Y_p(n)$ is the frequency-domain estimated signal of the pth sound source in the nth frame, and $Y_p(k,n)$ represents the frequency-domain estimated signal of the pth sound source at the kth frequency point of the nth frame, that is, the frequency-domain priori estimated signal.

By updating the separation matrix according to the above method, a more accurate frequency domain estimation signal can be obtained with higher separation performance. After time-frequency conversion, the audio signal from the sound source may be restored.

Figure 2:
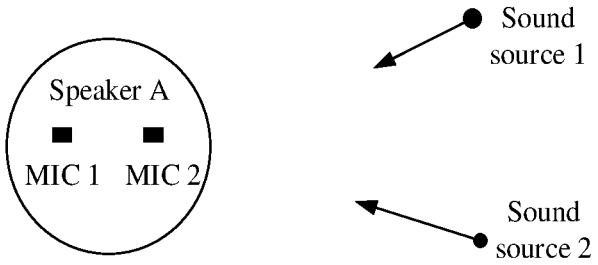
FIG. 2 is a schematic diagram of an application scenario of an audio signal processing method according to an exemplary embodiment.
Figure 3:
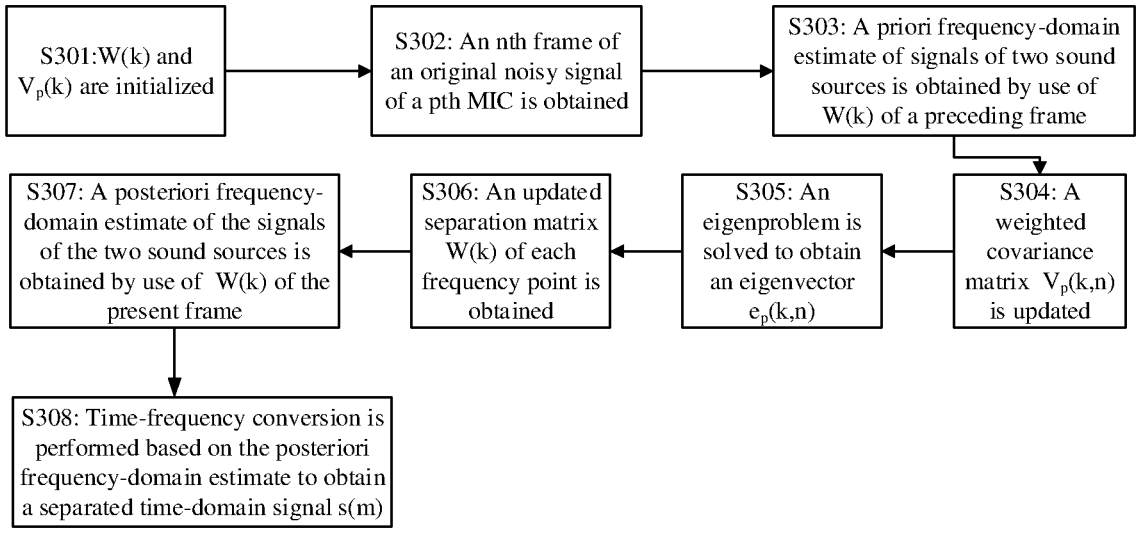
FIG. 3 is a flowchart of an audio signal processing method according to an exemplary embodiment.

FIG. 2 is a schematic diagram of an application scenario of an audio signal processing method according to an exemplary embodiment. FIG. 3 is a flowchart of an audio signal processing method according to an exemplary embodiment. Referring to FIGS. 2 and 3, in the audio signal processing method, sound sources include a sound source 1 and a sound source 2, and MICs include a MIC 1 and a MIC 2. Based on the audio signal processing method, the sound source 1 and the sound source 2 are recovered from signals of the MIC 1 and the MIC 2. As shown in FIG. 3, the method includes the following operations.

In operation S301, W(k) and $V_p(k)$ are initialized.

Initialization may include the following operations.

It is supposed that a system frame length is Nfft, and a frequency point is K=Nfft/2+1.

1) A separation matrix of each frequency point is initialized.

$$W(k) = [w_1(k), w_2(k)]^H = \begin{bmatrix} 1 & 0 \\ 0 & 1 \end{bmatrix}, \text{ where } \begin{bmatrix} 1 & 0 \\ 0 & 1 \end{bmatrix}$$

is an identity matrix, k is a frequency point, and k=1,L, K

2) A weighted covariance matrix $V_p(k)$ of each sound source at each frequency point is initialized.

$$V_p(k) = \begin{bmatrix} 0 & 0 \\ 0 & 0 \end{bmatrix}, \text{ where } \begin{bmatrix} 0 & 0 \\ 0 & 0 \end{bmatrix}$$

is a zero matrix, p represents a MIC, and p=1, 2.

In operation S302, an nth frame of original noisy signal of the pth MIC is obtained.

$x_p^n(m)$ represents a frame of time-domain signal of the pth MIC. m=1, . . . , Nffi Nfft represents the system frame length and the length of FFT, and M represents a frame shift.

An asymmetric analysis window is added to $x_p^n(m)$ for performing FFT to obtain:

$$X_p(k,n)=FFT(x_p^m(m)\cdot h_A(m))m=1, \ldots ,\text{Nfft}p=1,2$$

where m is the number of points selected for Fourier transform, FFT is fast Fourier transform, and $x_p^n(m)$ is an nth frame of time-domain signal of the pth MIC. Herein, the time-domain signal is an original noisy signal. $h_A(m)$ is the asymmetric analysis window.

A measured signal of $X_p(k,n)$ is $X(k,n)=[X_1(k,n), X_2(k,n)]^T$, where $[X_1(k,n), X_2(k,n)]^T$ is a transposed matrix.

STFT refers to multiplying a time-domain signal of a current frame by an analysis window and performing FFT to obtain time-frequency data. A separation matrix may be estimated through an algorithm to obtain time-frequency data of a separated signal, IFFT may be performed to convert the time-frequency data to the time domain, and then the converted signal may be multiplied with a synthesis window and added to a time-domain overlapping part output from a preceding frame to obtain a reconstructed separated time-domain signal. This is called an overlap-add technology.

Existing windowing algorithms generally apply a symmetry based Hanning window or Hamming window or other window functions. For example, a root period Hanning window may be used:

$$H_N(m) = \frac{1}{2}\left(1 - \cos\left(2\pi\frac{m-1}{N}\right)\right), \quad 1 \le m \le N$$

where the frame shift is $$M = \frac{Nfft}{2},$$

and the window length is N=Nfft. The system latency is Nfft points. Since Nfft is generally 4096 or greater, the latency may be 256 ms or greater when a system sampling rate is $f_s$=16 kHz.

In the embodiments of the present disclosure, an asymmetric analysis window and a synthesis window may be adopted, a window length may be N=Nfft, and a frame shift may be M. In order to obtain a low latency, M generally is small. For example, it may be set to $$M = \frac{Nfft}{4}, M = \frac{Nfft}{8},$$

or other values.

For example, the asymmetric analysis window may apply the following function:

$$h_A(m) = \begin{cases} \sqrt{H_{2(N-M)}(m)} & 1 \le m \le N-M \\ \sqrt{H_{2M}(m-(N-2M))} & N-M \le m \le N \\ 0 & \text{other} \end{cases}$$

The asymmetric synthesis window may apply the following function:

$$h_S(m) = \begin{cases} \dfrac{H_{2M}(m-(N-2M))}{\sqrt{H_{2(N-M)}(m)}} & N-2M+1 \le m \le N-M \\ \sqrt{H_{2M}(m-(N-2M))} & N-M+1 \le m \le N \\ 0 & \text{other} \end{cases}$$

Figure 4:
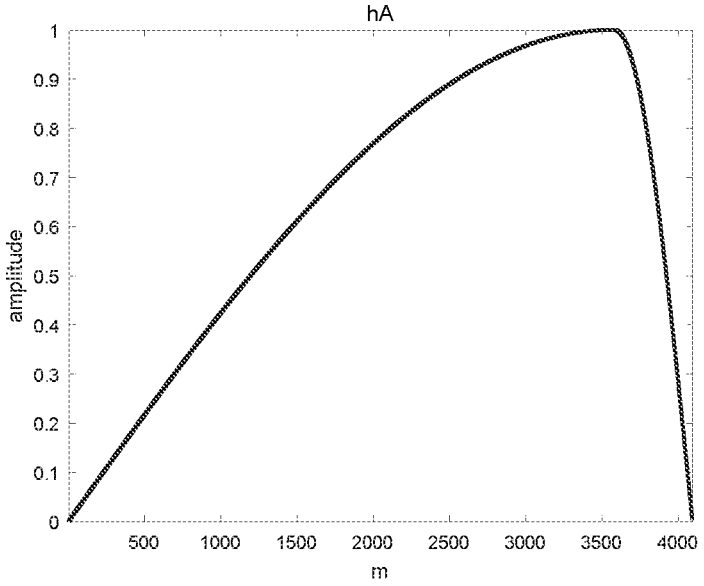
FIG. 4 is a function graph of an asymmetric analysis window according to an exemplary embodiment.
Figure 5:
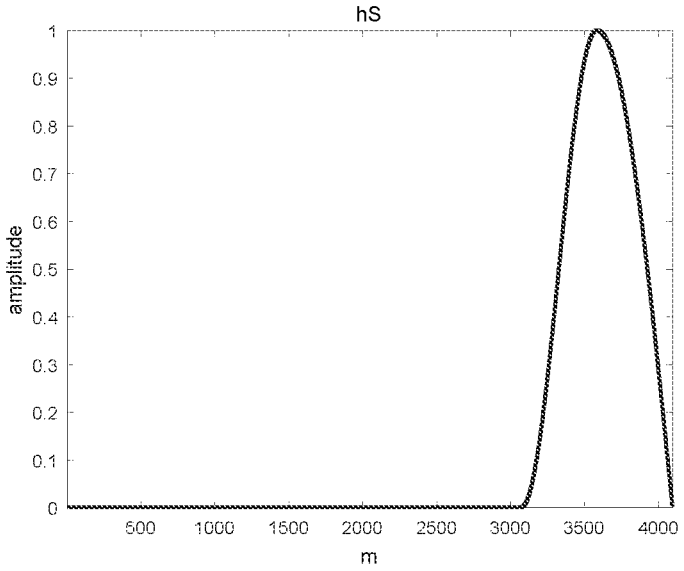
FIG. 5 is a function graph of an asymmetric synthesis window according to an exemplary embodiment.

When N=4096 and M=512, the function curve of the asymmetric analysis window is as shown in FIG. 4, and the function curve of the asymmetric synthesis window is as shown in FIG. 5.

In operation S303, a priori frequency-domain estimate of signals of the two sound sources is obtained by use of W(k) of a preceding frame.

It may be set that the priori frequency-domain estimate of the signals of the two sound sources is $Y(k\ n)=[Y_1(k,n), Y_2(k,n)]^T$, where $Y_1(k,n)$, $Y_2$ (k,n) n) are estimated values of the sound source 1 and the sound source 2 at a frequency-frequency point (k,n) respectively.

A measured matrix X(k,n) may be separated through the separation matrix W(k) to obtain Y(k,n)=W(k)X(k,n), where W'(k) is a separation matrix of a preceding frame (i.e., a last frame prior to a current frame).

Then, a priori frequency-domain estimate of the nth sound source in the pth frame is: $\overline{Y}_p(n)=[Y_p(1,n),L\ Y_p(K,n)]^T$.

In operation S304, a weighted covariance matrix $V_p(k,n)$ is updated.

The updated weighted covariance matrix may be calculated by: $V_p(k,n)=\beta V_p(k,n-1)+(1-\beta)\varphi_p(k,n)\ X_p\ (k,n)\ X_p^H(k,n)$ where β is a smoothing coefficient, β being 0.98 in an example; $V_p(k,n-1)$ is a weighted covariance matrix of the preceding frame; $X_p^H(k,n)$ a conjugate transpose of $X_p(k,n)$;

$$\varphi_p(n) = \frac{G'(\overline{Y}_p(n))}{r_p(n)}$$

is a weighting coefficient, $$r_p(n) = \sqrt{\sum_{k=1}^{K} |Y_p(k,n)|^2}$$

being an auxiliary variable; and $G(\overline{Y}_p(n))=-\log p(\overline{Y}_p(n))$ is a contrast function.

$p(\overline{Y}_p(n))$ represents a whole-band-based multidimensional super-Gaussian priori probability density function of the pth sound source. In an example, $$p(\overline{Y}_p(n)) = \exp\left(-\sqrt{\sum_{k=1}^{K} |Y_p(k,n)|^2}\right).$$

In such case, if $$G(\overline{Y}_p(n)) = -\log p(\overline{Y}_p(n)) = \sqrt{\sum_{k=1}^{K} |Y_p(k,n)|^2} = r_p(n),$$

$$\text{then } \varphi_p(n) = \frac{1}{\sqrt{\sum_{k=1}^{K} |Y_p(k,n)|^2}}.$$

In operation S305, an eigenproblem is solved to obtain an eigenvector $e_p(k,n)$ Herein, $e_p(k,n)$ is an eigenvector corresponding to the pth MIC.

The eigenproblem $V_2(k,n)e_p(k,n)=\lambda_p(k,n)V_1(k,n)e_p(k,n)$ is solved to obtain:

$$\lambda_1(k,n) = \frac{tr(H(k,n)) + \sqrt{tr(H(k,n))^2 - 4det(H(k,n))}}{2},$$

$$e_1(k,n) = \begin{pmatrix} H_{22}(k,n) - \lambda_1(k,n) \\ -H_{21}(k,n) \end{pmatrix},$$

$$\lambda_2(k,n) = \frac{tr(H(k,n)) - \sqrt{tr(H(k,n))^2 - 4det(H(k,n))}}{2} \text{ and}$$

$$e_2(k,n) = \begin{pmatrix} -H_{12}(k,n) \\ H_{11}(k,n) - \lambda_2(k,n) \end{pmatrix},$$

where $H(k,n)=V_1^{-1}(k,n)V_2(k,n)$, tr(A) is a trace function and refers to making a sum of elements on a main diagonal of a matrix A; det(A) refers to calculating a determinant of the matrix A; and $\lambda_1$, $\lambda_2$, $e_1$, and $e_2$ are eigen values.

In operation S306, an updated separation matrix W(k) of each frequency point is obtained.

The updated separation matrix $$w_p(k) = \frac{e_p(k, n)}{e_p^H(k, n)V_P(k, n)e_p(k, n)}$$

of the current frame is obtained based on the eigenvector of the eigenproblem.

In operation S307, a posteriori frequency-domain estimate of the signals of the two sound sources is obtained by use of W(k) of the current frame.

The original noisy signal is separated by use of W(k) of the current frame to obtain the posteriori frequency-domain estimate $Y(k,n)=[Y_1(k,n),Y_2(k,n)]^T=W(k)X(k,n)$ of the signals of the two sound sources.

In operation S308, time-frequency conversion is performed based on the posteriori frequency-domain estimate to obtain a separated time-domain signal.

IFFT may be performed, a synthesis window may be added, the time-domain overlapping part of a current frame may be added to the time-domain overlapping part of a preceding frame to obtain the separated time-domain signal $y_p(m)$ of the current frame, and p=1, 2.

$$\bar{y}_p^m(n)=\mathrm{IFFY}(\bar{Y}_p(n)),\ m=1, \ldots, \mathrm{Nfft}$$

$$\bar{y}_p^n(m)=\bar{y}_p(m)\cdot h_S(m),\ m=1, \ldots, \mathrm{Nfft}$$

$$y_p^{cur}(m)=\bar{y}_p^n(m+(N-2M)),\ m=1, \ldots, 2M$$

$$y_p(m)=y_p^{cur}(m)+y_p^{pre}(m),\ m=1, \ldots, M$$

$\bar{y}_p^n(m)$ is a signal after windowing the time-domain signal of the current frame, $y_p^{pre}(m)$ is the time-domain overlapping part of each frame preceding the current frame, and $y_p^{cur}(m)$ is the time-domain overlapping part of the current frame.

$y_p^{pre}(m)$ is updated for use of overlapping addition of the next frame.

$y_p^{pre}(m)=y_p^{cur}(m+M)$, m=1, . . . , M

ISTFT and overlapping-addition may be performed on $\bar{Y}_p(n)=[Y_p(1,n), \ldots Y_p(K,n)]^T$ k=1, . . . , K respectively to obtain a separated time-domain sound source signal $s_p^n(m)$, that is, $s_p^n(m)=\mathrm{ISFT}(\bar{Y}_p(n))$, where m=1, . . . , Nfft, and p=1, 2.

After the above processing by the analysis window and the synthesis window, the system latency can be 2M points and the latency can be $2M/f_s$ ms (millisecond). When the number of FFT points is changed, the system latency that meets actual needs can be obtained by controlling the size of M, and the contradiction between the system latency and the performance of the algorithm is solved.

Figure 6:
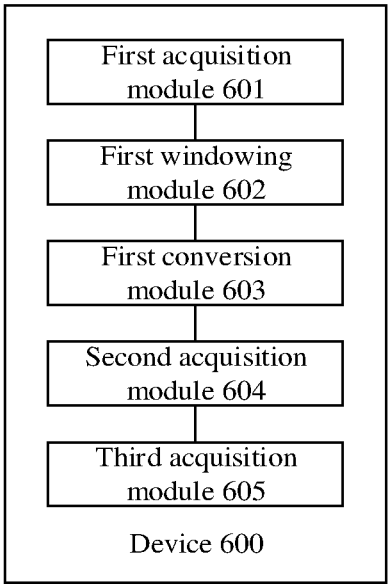
FIG. 6 is a block diagram of an audio signal processing device according to an exemplary embodiment.

FIG. 6 is a block diagram of an audio signal processing device 600 according to an exemplary embodiment. Referring to FIG. 6, the device 600 includes a first acquisition module 601, a first windowing module 602, a first conversion module 603, a second acquisition module 604, and a third acquisition module 605. Each of these modules may be implemented as software, or hardware, or a combination of software and hardware.

The first acquisition module 601 is configured to acquire audio signals from at least two sound sources respectively through at least two MICs to obtain respective original noisy signals of the at least two MICs in a time domain.

The first windowing module 602 is configured to perform, for each frame in the time domain, a windowing operation on the respective original noisy signals of the at least two MICs using a first asymmetric window to acquire windowed noisy signals.

The first conversion module 603 is configured to perform time-frequency conversion on the windowed noisy signals to acquire respective frequency-domain noisy signals of the at least two sound sources.

The second acquisition module 604 is configured to acquire frequency-domain estimated signals of the at least two sound sources according to the frequency-domain noisy signals.

The third acquisition module 605 is configured to obtain audio signals produced respectively by the at least two sound sources according to the frequency-domain estimated signals.

In some embodiments, a definition domain of the first asymmetric window $h_A(m)$ may be greater than or equal to 0 and less than or equal to N, a peak may be $h_A(m_1)=m_1$ may be less than N and greater than 0.5N, and N may be a frame length of each of the audio signals.

In some embodiments, the first asymmetric window $h_A(m)$ may include:

$$h_A(m) = \begin{cases} \sqrt{H_{2(N-M)}(m)} & 1 \le m \le N-M \\ \sqrt{H_{2M}(m-(N-2M))} & N-M \le m \le N \\ 0 & \text{other} \end{cases}$$

where $H_K(x)$ is a Hanning window with a window length of K, and M is a frame shift.

In some embodiments, the third acquisition module 605 may include: a second conversion module, configured to perform time-frequency conversion on the frequency-domain estimated signals to acquire respective time-domain separation signals of the at least two sound sources; a second windowing module, configured to perform a windowing operation on the respective time-domain separation signals of the at least two sound sources using a second asymmetric window to acquire windowed separation signals; and a first acquisition sub-module, configured to acquire audio signals produced respectively by the at least two sound sources according to windowed separation signals.

In some embodiments, the second windowing module is configured to: perform a windowing operation on a time-domain separation signal of an nth frame using the second asymmetric window $h_S(m)$ to acquire an nth-frame windowed separation signal. The first acquisition sub-module is configured to: superimpose an audio signal of a (n−1)th frame according to the nth-frame windowed separation signal to obtain an audio signal of the nth frame, where n is an integer greater than 1.

In some embodiments, a definition domain of the second asymmetric window $h_S(m)$ may be greater than or equal to 0 and less than or equal to N, a peak may be $h_S(m_2)=1$, $m_2$ may be equal to N−M, N may be a frame length of each of the audio signals, and M is a frame shift.

In some embodiments, the second asymmetric window $h_S(m)$ may include:

$$h_S(m) = \begin{cases} \dfrac{H_{2M}(m-(N-2M))}{\sqrt{H_{2(N-M)}(m)}} & N-2M+1 \le m \le N-M \\ \sqrt{H_{2M}(m-(N-2M))} & N-M+1 \le m \le N \\ 0 & \text{other} \end{cases}$$

where $H_K(x)$ is a Hanning window with a window length of K.

In some embodiments, the second acquisition module may include: a second acquisition sub-module, configured to acquire a frequency-domain priori estimated signal according to the frequency-domain noisy signals; a determination sub-module, configured to determine a separation matrix of each frequency point according to the frequency-domain priori estimated signal; and a third acquisition sub-module, configured to acquire the frequency-domain estimated signals of the at least two sound sources according to the separation matrix and the frequency-domain noisy signals.

With respect to the device in the above embodiments, the specific manners for performing operations by individual modules therein have been described in detail in the embodiments regarding the method, which will not be repeated herein.

Figure 7:
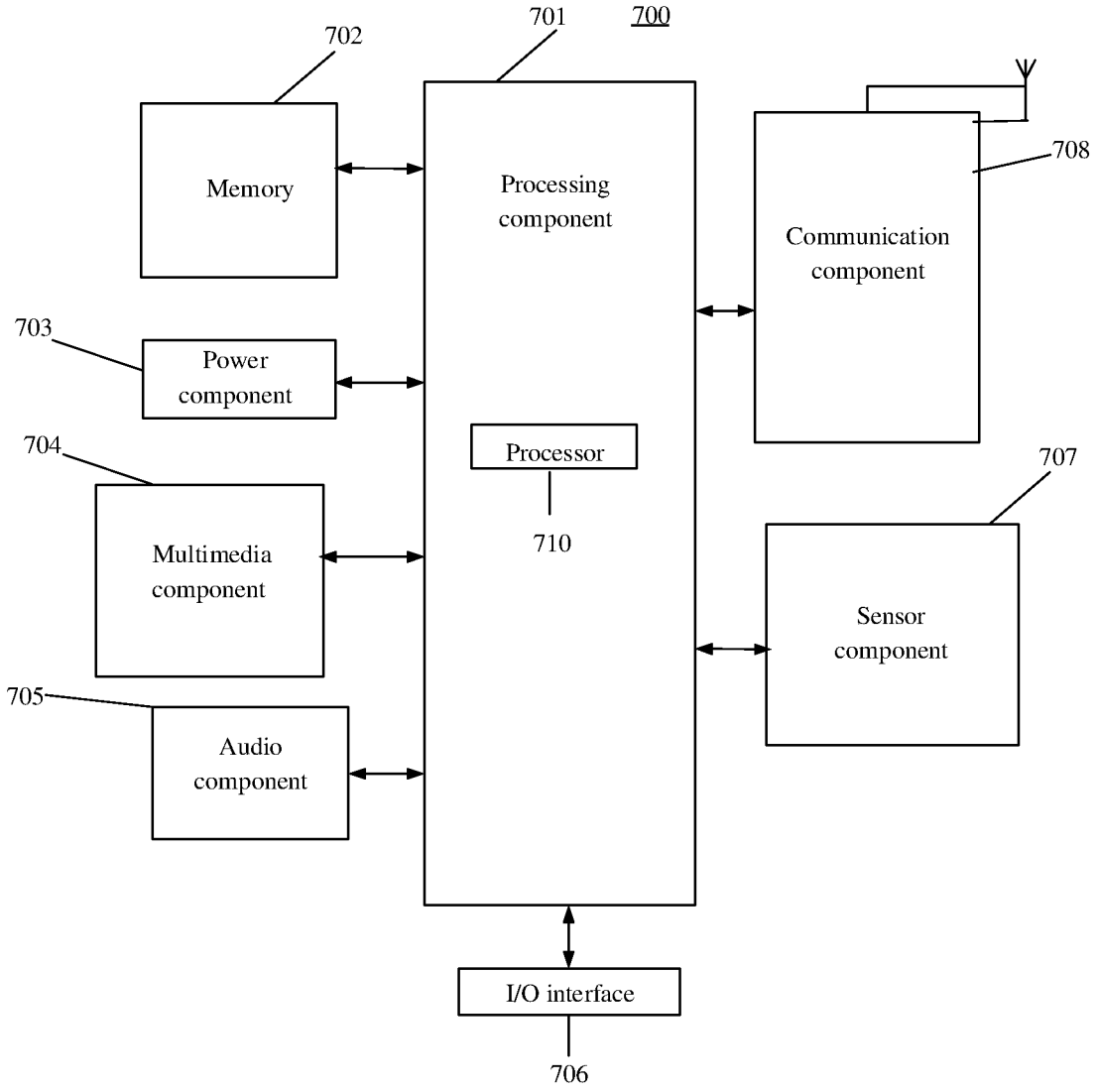
FIG. 7 is a block diagram of an audio signal processing device according to an exemplary embodiment.

FIG. 7 is a block diagram of a device 700 for audio signal processing according to an exemplary embodiment. For example, the device 700 may be a mobile phone, a computer, a digital broadcast terminal, a messaging device, a gaming console, a tablet, a medical device, exercise equipment, a personal digital assistant and the like.

Referring to FIG. 7, the device 700 may include one or more of the following components: a processing component 701, a memory 702, a power component 703, a multimedia component 704, an audio component 705, an Input/Output (I/O) interface 706, a sensor component 707, and a communication component 708.

The processing component 701 typically controls overall operations of the device 700, such as the operations associated with display, telephone calls, data communications, camera operations, and recording operations. The processing component 701 may include one or more processors 710 to execute instructions to perform all or part of the operations in the abovementioned method. Moreover, the processing component 701 may include one or more modules which facilitate interaction between the processing component 701 and the other components. For instance, the processing component 701 may include a multimedia module to facilitate interaction between the multimedia component 704 and the processing component 701.

The memory 710 is configured to store various types of data to support the operation of the device 700. Examples of such data include instructions for any application programs or methods operated on the device 700, contact data, phonebook data, messages, pictures, video, etc. The memory 702 may be implemented by any type of volatile or non-volatile memory devices, or a combination thereof, such as an Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 703 provides power for various components of the device 700. The power component 703 may include a power management system, one or more power supplies, and other components associated with generation, management and distribution of power for the device 700.

The multimedia component 704 includes a screen providing an output interface between the device 700 and a user. For example, the screen is configured to display an effect of audio signal processing. In some embodiments, the screen may include a Liquid Crystal Display (LCD) and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some embodiments, the multimedia component 704 includes a front camera and/or a rear camera. The front camera and/or the rear camera may receive external multimedia data when the device 700 is in an operation mode, such as a photographing mode or a video mode. Each of the front camera and the rear camera may be a fixed optical lens system or have focusing and optical zooming capabilities.

The audio component 705 is configured to output and/or input an audio signal. For example, the audio component 705 includes a MIC, and the MIC is configured to receive an external audio signal when the device 700 is in the operation mode, such as a call mode, a recording mode and a voice recognition mode. The received audio signal may further be stored in the memory 710 or sent through the communication component 708. In some embodiments, the audio component 705 further includes a speaker configured to output the audio signal.

The I/O interface 706 provides an interface between the processing component 701 and a peripheral interface module, and the peripheral interface module may be a keyboard, a click wheel, a button and the like. The button may include, but not limited to: a home button, a volume button, a starting button and a locking button.

The sensor component 707 includes one or more sensors configured to provide status assessment in various aspects for the device 700. For instance, the sensor component 707 may detect an on/off status of the device 700 and relative positioning of components, such as a display and small keyboard of the device 700, and the sensor component 707 may further detect a change in a position of the device 700 or a component of the device 700, presence or absence of contact between the user and the device 700, orientation or acceleration/deceleration of the device 700 and a change in temperature of the device 700. The sensor component 707 may include a proximity sensor configured to detect presence of an object nearby without any physical contact. The sensor component 707 may also include a light sensor, such as a Complementary Metal Oxide Semiconductor (CMOS) or Charge Coupled Device (CCD) image sensor, configured for use in an imaging application. In some embodiments, the sensor component 707 may also include an acceleration sensor, a gyroscope sensor, a magnetic sensor, a pressure sensor or a temperature sensor.

The communication component 708 is configured to facilitate wired or wireless communication between the device 700 and another device. The device 700 may access a communication-standard-based wireless network, such as a Wireless Fidelity (WiFi) network, a 4th-Generation (4G) or 5th-Generation (5G) network or a combination thereof. In an exemplary embodiment, the communication component 708 receives a broadcast signal or broadcast associated information from an external broadcast management system through a broadcast channel. In an exemplary embodiment, the communication component 708 further includes a Near Field Communication (NFC) module to facilitate short-range communication. In an exemplary embodiment, the communication component 708 may be implemented based on a Radio Frequency Identification (RFID) technology, an Infrared Data Association (IrDA) technology, an Ultra-Wide Band (UWB) technology, a Bluetooth (BT) technology and another technology.

In an exemplary embodiment, the device 700 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to perform the above described methods.

In an exemplary embodiment, there is also provided a non-transitory computer-readable storage medium including an instruction, such as the memory 702 including instructions, and the instructions may be executed by the processor 710 of the device 700 to perform the above described methods. For example, the non-transitory computer-readable storage medium may be a ROM, a Random Access Memory (RAM), a Compact Disc Read-Only Memory (CD-ROM), a magnetic tape, a floppy disc, an optical data storage device and the like.

A non-transitory computer-readable storage medium is provided. When instructions in the storage medium are executed by a processor of a mobile terminal, the mobile terminal can perform the above described methods.

In the embodiments of the present disclosure, audio signals may be processed by windowing, so that the audio signal of each frame can get stronger and then weaker. There is an overlapping area between every two adjacent frames, that is, a frame shift, so that the separated signal can maintain continuity. Meanwhile, in the embodiments of the present disclosure, an asymmetric window is used to window the audio signals, so that the length of a frame shift can be set according to actual needs. If a smaller frame shift is set, less system latency can be achieved, which in turn improves the processing efficiency and the timeliness of separated audio signals.

Other implementations of the present disclosure will be apparent to those skilled in the art from consideration of the specification and practice of the present disclosure. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

What is claimed is:

1. A method for audio signal processing, comprising:

acquiring audio signals from at least two sound sources respectively through at least two microphones (MICs) to obtain respective original noisy signals of the at least two MICs in a time domain;

for each frame in the time domain, performing a windowing operation on the respective original noisy signals of the at least two MICs using a first asymmetric window to acquire respective windowed noisy signals of the at least two MICs;

performing time-frequency conversion on the respective windowed noisy signals of the at least two MICs to acquire respective frequency-domain noisy signals of the at least two sound sources;

acquiring frequency-domain estimated signals of the at least two sound sources according to the respective frequency-domain noisy signals of the at least two sound sources; and obtaining audio signals produced respectively by the at least two sound sources according to the respective frequency-domain estimated signals of the at least two sound sources, wherein obtaining the audio signals comprises:

performing time-frequency conversion on the respective frequency-domain estimated signals of the at least two sound sources to acquire respective time-domain separation signals of the at least two sound sources;

performing a windowing operation on the respective time-domain separation signals of the at least two sound sources using a second asymmetric window to acquire respective windowed separation signals of the at least two sound sources; and acquiring the audio signals produced respectively by the at least two sound sources according to the respective windowed separation signals of the at least two sound sources.

2. The method of claim 1, wherein a definition domain of the first asymmetric window $h_A(m)$ is greater than or equal to 0 and less than or equal to N, a peak is $h_A(m_1)=1$, $m_1$ is less than N and greater than 0.5N, and N is a frame length of each of the audio signals.

3. The method of claim 2, wherein the first asymmetric window $h_A$ (m) comprises:

$$h_A(m) = \begin{cases} \sqrt{H_{2(N-M)}(m)} & 1 \le m \le N-M \\ \sqrt{H_{2M}(m-(N-2M))} & N-M \le m \le N \\ 0 & \text{other} \end{cases}$$

where $H_K(x)$ is a Hanning window with a window length of K, and M is a frame shift.

4. The method of claim 1, wherein the performing a windowing operation on the respective time-domain separation signals of the at least two sound sources using a second asymmetric window to acquire respective windowed separation signals of the at least two sound sources comprises:

performing a windowing operation on a time-domain separation signal of an nth frame using the second asymmetric window $h_S(m)$ to acquire an nth-frame windowed separation signal; and the acquiring audio signals produced respectively by the at least two sound sources according to the respective windowed separation signals of the at least two sound sources comprises:

superimposing an audio signal of an (n−1)th frame according to the nth-frame windowed separation signal to obtain an audio signal of the nth frame, where n is an integer greater than 1.

5. The method of claim 1, wherein a definition domain of the second asymmetric window $h_S$ (m) is greater than or equal to 0 and less than or equal to N, a peak is $h_S(m_2)=1$, $m_2$ is equal to N−M, N is a frame length of each of the audio signals, and M is a frame shift.

6. The method of claim 5, wherein the second asymmetric window $h_S$ comprises:

$$h_S(m) = \begin{cases} \dfrac{H_{2M}(m-(N-2M))}{\sqrt{H_{2(N-M)}(m)}} & N-2M+1 \le m \le N-M \\ \sqrt{H_{2M}(m-(N-2M))} & N-M+1 \le m \le N \\ 0 & \text{other} \end{cases}$$

where $H_K(x)$ is a Hanning window with a window length of K.

7. The method of claim 1, wherein the acquiring frequency-domain estimated signals of the at least two sound sources according to the respective frequency-domain noisy signals of the at least two sound sources comprises:

acquiring a frequency-domain priori estimated signal according to the respective frequency-domain noisy signals;

determining a separation matrix of each frequency point according to the frequency-domain priori estimated signal; and acquiring the respective frequency-domain estimated signals of the at least two sound sources according to the separation matrix and the respective frequency-domain noisy signals.

8. A device for audio signal processing, comprising:

a processor; and a memory configured to store instructions executable by the processor, wherein the processor is configured to:

acquire audio signals from at least two sound sources respectively through at least two microphones (MICs) to obtain respective multiple frames of original noisy signals of the at least two MICs in a time domain;

perform, for each frame in the time domain, a windowing operation on the respective original noisy signals of the at least two MICs using a first asymmetric window to acquire respective windowed noisy signals of the at least two MICs;

perform time-frequency conversion on the respective windowed noisy signals of the at least two MICs to acquire respective frequency-domain noisy signals of the at least two sound sources;

acquire frequency-domain estimated signals of the at least two sound sources according to the respective frequency-domain noisy signals of the at least two sound sources; and obtain audio signals produced respectively by the at least two sound sources according to the respective frequency-domain estimated signals of the at least two sound sources, wherein the processor is further configured to:

perform time-frequency conversion on the respective frequency-domain estimated signals of the at least two sound sources to acquire respective time-domain separation signals of the at least two sound sources;

perform a windowing operation on the respective time-domain separation signals of the at least two sound sources using a second asymmetric window to acquire respective windowed separation signals of the at least two sound sources; and acquire the audio signals produced respectively by the at least two sound sources according to the respective windowed separation signals of the at least two sound sources.

9. The device of claim 8, wherein a definition domain of the first asymmetric window $h_A(m)$ is greater than or equal to 0 and less than or equal to N, a peak is $h_A(m_1)=1$, $m_1$ is less than N and greater than 0.5N, and N is a frame length of each of the audio signals.

10. The device of claim 9, wherein the first asymmetric window $h_A$ (m) comprises:

$$h_A(m) = \begin{cases} \sqrt{H_{2(N-M)}(m)} & 1 \le m \le N-M \\ \sqrt{H_{2M}(m-(N-2M))} & N-M \le m \le N \\ 0 & \text{other} \end{cases}$$

where $H_K(x)$ is a Hanning window with a window length of K, and M is a frame shift.

11. The device of claim 8, wherein the processor is configured to:

perform a windowing operation on a time-domain separation signal of an nth frame using the second asymmetric window $h_S(m)$ to acquire an nth-frame windowed separation signal; and superimpose an audio signal of an (n−1)th frame according to the nth-frame windowed separation signal to obtain an audio signal of the nth frame, where n is an integer greater than 1.

12. The device of claim 11, wherein a definition domain of the second asymmetric window $h_S(m)$ is greater than or equal to 0 and less than or equal to N, a peak is $h_S(m_2)=1$, $m_2$ is equal to N−M, N is a frame length of each of the audio signals, and M is a frame shift.

13. The device of claim 12, wherein the second asymmetric window $h_S$ comprises:

$$h_S(m) = \begin{cases} \dfrac{H_{2M}(m-(N-2M))}{\sqrt{H_{2(N-M)}(m)}} & N-2M+1 \le m \le N-M \\ \sqrt{H_{2M}(m-(N-2M))} & N-M+1 \le m \le N \\ 0 & \text{other} \end{cases}$$

where $H_K(x)$ is a Hanning window with a window length of K.

14. The device of claim 8, wherein the processor is further configured to:

acquire a frequency-domain priori estimated signal according to the frequency-domain noisy signals;

determine a separation matrix of each frequency point according to the respective frequency-domain priori estimated signal; and acquire the respective frequency-domain estimated signals of the at least two sound sources according to the separation matrix and the respective frequency-domain noisy signals.

15. The device of claim 8, further comprising:

a screen configured to display an effect of the audio signal processing.

16. A non-transitory computer-readable storage medium, storing computer-executable instructions that, when executed by a processor, implement operations of:

acquiring audio signals from at least two sound sources respectively through at least two microphones (MICs) to obtain respective original noisy signals of the at least two MICs in a time domain;

for each frame in the time domain, performing a windowing operation on the respective original noisy signals of the at least two MICs using a first asymmetric window to acquire respective windowed noisy signals of the at least two MICs;

performing time-frequency conversion on the respective windowed noisy signals of the at least two MICs to acquire respective frequency-domain noisy signals of the at least two sound sources;

acquiring frequency-domain estimated signals of the at least two sound sources according to the respective frequency-domain noisy signals of the at least two sound sources; and obtaining audio signals produced respectively by the at least two sound sources according to the respective frequency-domain estimated signals of the at least two sound sources, wherein the non-transitory computer-readable storage medium stores further computer-executable instructions for:

performing time-frequency conversion on the respective frequency-domain estimated signals of the at least two sound sources to acquire respective time-domain separation signals of the at least two sound sources;

performing a windowing operation on the respective time-domain separation signals of the at least two sound sources using a second asymmetric window to acquire respective windowed separation signals of the at least two sound sources; and acquiring the audio signals produced respectively by the at least two sound sources according to the respective windowed separation signals of the at least two sound sources.

17. The non-transitory computer-readable storage medium of claim 16, wherein a definition domain of the first asymmetric window $h_A(m)$ is greater than or equal to 0 and less than or equal to N, a peak is $h_A(m_1)=1$, $m_1$ is less than N and greater than 0.5N, and N is a frame length of each of the audio signals.

18. The non-transitory computer-readable storage medium of claim 17, wherein the first asymmetric window $h_A(m)$ comprises:

$$h_A(m) = \begin{cases} \sqrt{H_{2(N-M)}(m)} & 1 \le m \le N-M \\ \sqrt{H_{2M}(m-(N-2M))} & N-M \le m \le N \\ 0 & \text{other} \end{cases}$$

where $H_K(x)$ is a Hanning window with a window length of K, and M is a frame shift.

* * * * *